United States Patent [19]

Knapp

[11] 4,108,128

[45] Aug. 22, 1978

[54] FUEL SUPPLY SYSTEM FOR INTERNAL COMBUSTION ENGINES

[75] Inventor: Heinrich Knapp, Leonberg-Silberberg, Fed. Rep. of Germany

[73] Assignee: Robert Bosch GmbH, Stuttgart, Fed. Rep. of Germany

[21] Appl. No.: 744,363

[22] Filed: Nov. 23, 1976

[30] Foreign Application Priority Data

Dec. 12, 1975 [DE] Fed. Rep. of Germany ..... 2555996

[51] Int. Cl.[2] ..... F02M 39/02

[52] U.S. Cl. ..... 123/139 AW; 123/139 BG; 261/50 A; 261/44 A

[58] Field of Search ..... 123/139 AW, 139 BG; 261/44 A, 44 R, 50 A, 51, 65, 67

[56] References Cited

U.S. PATENT DOCUMENTS

| | | | |
|---|---|---|---|
| 1,547,296 | 7/1925 | Bullard | 261/44 R |
| 1,839,102 | 12/1931 | Kessel | 261/44 A |
| 1,951,262 | 3/1934 | Townsley | 261/44 A |
| 3,880,125 | 4/1975 | Kammerer et al. | 123/139 AW |
| 3,930,481 | 1/1976 | Eckert | 123/139 AW |
| 4,015,571 | 4/1977 | Stumpp | 123/139 AW |

FOREIGN PATENT DOCUMENTS

| | | | |
|---|---|---|---|
| 28,001 of | 1907 | United Kingdom | 261/44 R |

*Primary Examiner*—Charles J. Myhre
*Assistant Examiner*—Parshobam S. Lall
*Attorney, Agent, or Firm*—Edwin E. Greigg

[57] ABSTRACT

A fuel supply and mixture generating system for an internal combustion engine includes an air flow rate meter and, downstream thereof in the induction tube, a pivoting throttle plate actuated from the outside. Pivoting on the same shaft as the throttle plate is a mixture generating plate having a damping wing which moves in the same direction as the throttle plate in an appropriately configured wall region of the induction tube and a mixture generator wing with internal fuel channels and one or more fuel injection orifices at the edge where it defines the air flow cross section. The mixture generating plate is displaced by the air stream and this displacement is opposed by a spring. At full throttle, the force of the spring is changed by interaction of the throttle plate with the point of attachment of the spring.

12 Claims, 4 Drawing Figures

FUEL SUPPLY SYSTEM FOR INTERNAL COMBUSTION ENGINES

BACKGROUND OF THE INVENTION

The invention relates to a fuel supply system for mixture compressing and externally ignited internal combustion engines. The system includes an air flow rate meter disposed in the air induction tube of the engine and a subsequent arbitrarily actuated throttle valve. The air flow rate meter is displaced by the flowing air against a restoring force and displaces the movable part of a fuel metering valve for the purpose of metering out fuel proportional to the air flow.

In known fuel supply systems of this type, the preparation of the fuel-air mixture is satisfactory only within certain regions of rpm and load. The intensity of admixture of air and fuel is satisfactory only in these regions where the aspirated air causes the fuel to be finely atomized so as to produce a homogeneous combustible mixture for all the cylinders of the engine. In other domains of rpm and load, however, the engine receives a mixture which is either too lean or too rich and results in rough running or in undesirably high concentrations of toxic exhaust components. In the domain of partial load and at those engine speeds prescribed for exhaust emission tests, the relatively low air velocities in the induction tube cause the mixture preparation and distribution to be unsatisfactory.

OBJECT AND SUMMARY OF THE INVENTION

It is a principal object of the invention to provide a fuel supply system of the type described above which insures adequate mixture preparation and distribution even in the domain of partial engine load.

This and other objects are attained according to the invention by providing a mixture generator which is pivotable on the same axis as the throttle valve and a portion of which moves in a lateral enlargement of the air induction tube in a direction opposite the normal air flow rate. The restoring force on the mixture generator whose pivotal motions generally follow that of the throttle valve is exerted by a spring with a tension such that, in the upper domain of partial load, the mixture generator experiences a selectable pressure loss. The invention further provides that the force of the restoring spring may be reduced when the throttle valve is in a full-load position.

An advantageous feature of the invention is that the pressure loss caused by the force of the spring is approximately 15 percent in the partial load domain whereas, in the full load position of the throttle valve, the force of the spring can be so diminished that the pressure loss at the mixture generator is approximately 3 percent. The invention provides that the point of attachment of the restoring spring remote from the mixture generator is located on a movable element which can be displaced by the rotating throttle plate so as to tend to diminish the length of the restoring spring.

It is a further advantageous feature of the invention that the mixture generator is a pivotal flap having a damping wing and a generating wing in which the damping wing moves pivotally within the bulge of the induction tube and tends to follow the rotary motions of the throttle plate whereas the generating portion of the flap defines the effective flow aperture in the induction tube. The metered out fuel quantity is injected into the narrowest flow cross section defined by the edge of the mixture generator and the induction tube wall via at least one injection orifice located on the edge of the generator.

A further preferred feature of the invention provides a plunger inside of the fuel metering valve, actuated via appropriate linkage by the air flow rate meter, the plunger cooperating with a metering slit within a bushing.

Another advantageous feature of the invention is that the valve plunger has a groove and an axial control edge which cooperates with an axial control edge of the metering slit in the bushing and thereby forms the metering cross section. The metering cross section may be changed by an axial relative displacement of the plunger and the bushing as well as by a rotary relative displacement of these two parts. Furthermore, the axial displacement of the plunger may take place in dependence on the position of the air flow rate meter and the rotary displacement may take place in dependence on other operational parameters of the engine. Yet another feature of the invention is that the pressure difference across the fuel metering aperture is held constant by a differential pressure valve while the counter pressure at the metering aperture is provided by induction pressure upstream of the mixture generating wing admitted by an air aperture terminating in the induction tube. The differential pressure valve is embodied as a flat seat valve whose movable member is a diaphragm which experiences fuel pressure upstream of the metering orifice on one side while the other side experiences the induction tube pressure upstream of the mixture preparing wing as well as the force of a spring.

The invention will be better understood as well as further objects and advantages thereof will become more apparent from the ensuing detailed description of preferred embodiments taken in conjunction with the drawing.

DESCRIPTION OF THE PREFERRED EMBODIMENTS

Figure 1:
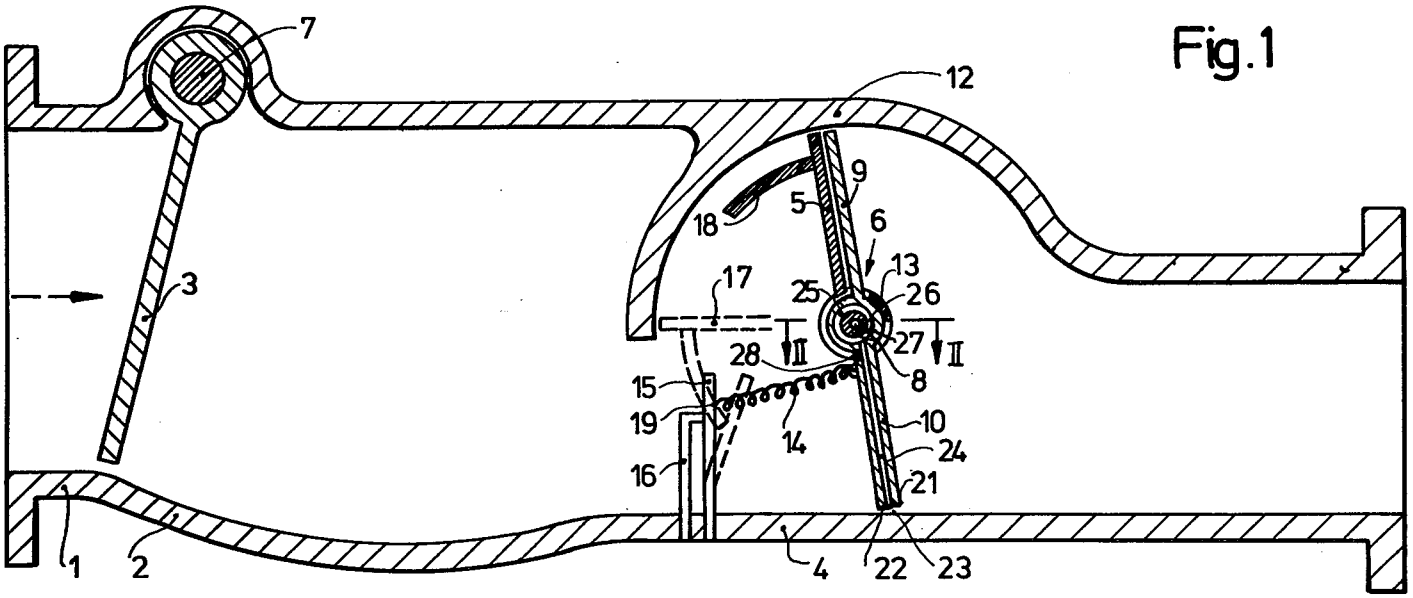
FIG. 1 is a cross section of the fuel supply system according to the invention.

Turning now to FIG. 1, there is illustrated a portion of an induction tube 1 including a region 2 with an air flow rate meter embodied as a baffle plate 3 and a further induction tube region 4 containing an arbitrarily settable throttle valve 5. The region 4 also contains a mixture generator flap 6 beyond which the air flows to one or several cylinders of an internal combustion engine (not shown). The air flow rate meter 3 moves in the appropriately dimensioned region 2 and follows an approximately linear function of the air flow rate. If the air pressure ahead of the air flow rate meter 3 is constant, then the pressure between the air flow rate meter 3 and the throttle valve 5 will also be substantially constant. The air flow rate meter 3 is rigidly attached to a transverse bearing shaft 7.

The mixture generating flap 6 is pivotably mounted on a bearing shaft 8 and has a damper wing 9 and a mixture generating wing 10. The damping wing 9 moves in a lateral bulge or recess 12 in the shape of a circular arc and its pivotal motions generally follow the pivotal motions of the throttle plate 5 which is attached to a bushing 13 around the bearing shaft 8. During opening motions of the throttle plate, the pivotal motion of the damping wing is thus in a direction essentially opposite the direction of the air flow. The bulge in the shape of a circular arc extends far enough into the induction tube that the throttle plate remains within the confines of the bulge even at full throttle positions. The generating wing 10 defines the narrowest flow cross section in the induction tube and thus the location of the highest air speed. The opening motions of the generating flap 6 take place against the force of a spring 14 one end of which is attached to the generating wing 10 while the other is attached to a leaf spring 15. The end of the leaf spring 15 remote from the generating wing is supported by a member 16 which defines the basic position of the leaf spring 15. The leaf spring 15 extends far enough into the induction tube so that an actuating arm 18, extending from the throttle plate, comes in contact with the spring 15 in the full load position 17, indicated by broken lines, so as to shift the point of attachment 19 of the spring 14 and to cause a shortening of the spring 14 and thereby to cause a diminution of the restoring force exerted by the spring 14.

Fuel is metered out in proportion to the aspirated air quantity and is injected preferably via an injection nozzle 21 located at the edge surface 22 of the generating wing 10 in the vicinity of the narrowest flow cross section 23 defined between the edge surface 22 and the induction tube wall where the highest air speed prevails. The injection nozzle 21 is connected via a line 24 with an annular groove 25 in the bearing shaft 8 and a lateral bore 26 and an axial bore 27 connect the annular groove 25 with the fuel metering valve assembly. An air hole 28 causes communication between the line 24 and the induction tube region 4 upstream of the generating wing 10 so that the induction tube pressure prevailing there acts as counter pressure downstream of the fuel metering location. In a manner not shown, the line 24 could be connected with several injection nozzles 21 disposed in the end face 22 of the generating wing 10. The injection nozzle may also be replaced by an injection slit or an injection valve.

Figure 3:
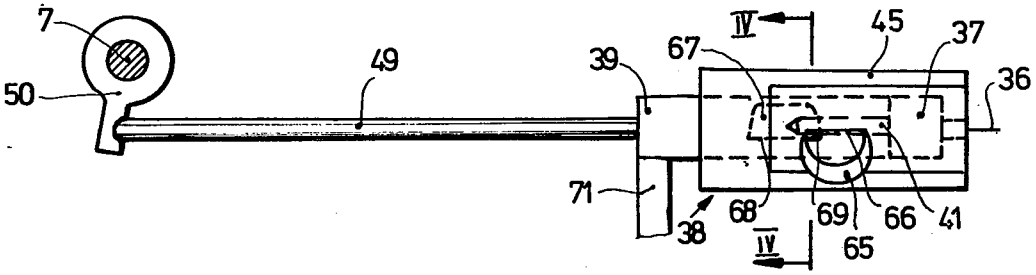
FIG. 3 is a section along the line III—III in FIG. 2.
Figures 2, 4:
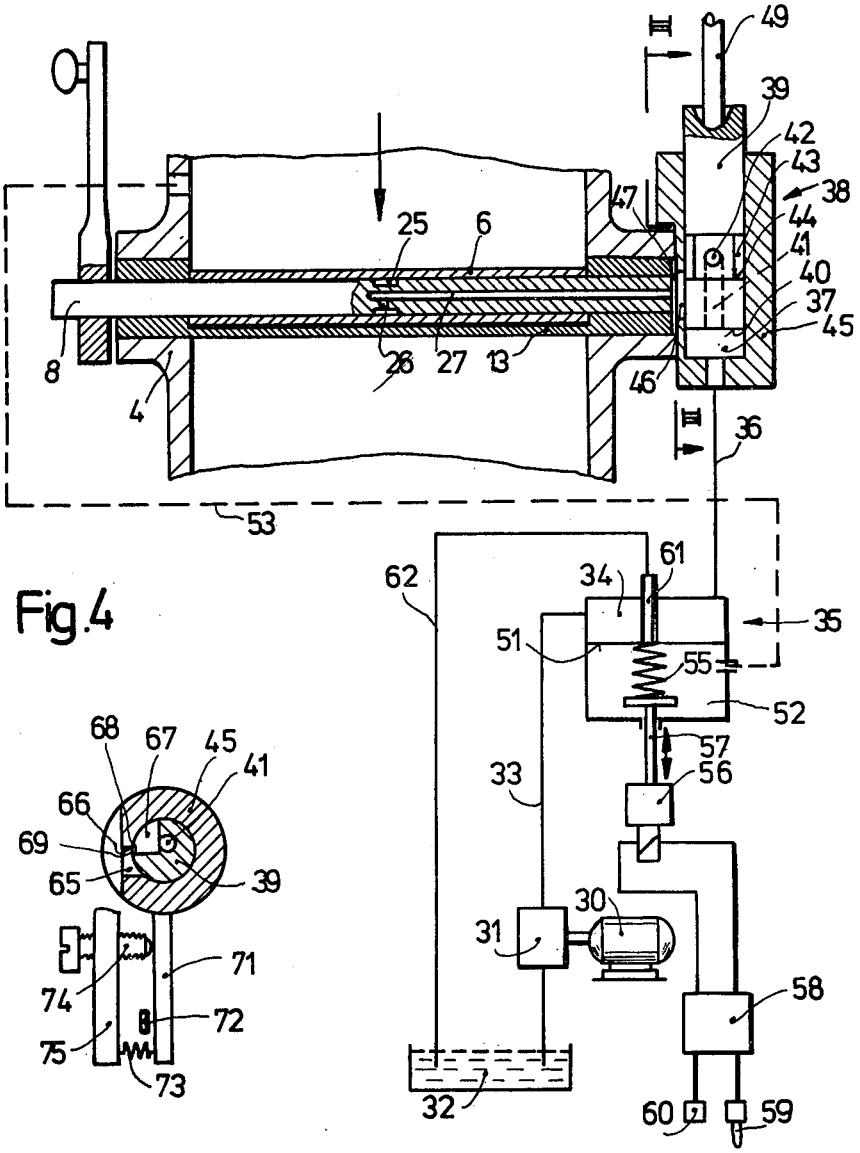
FIG. 2 is a section of the fuel supply system taken along the line II—II in FIG. 1.
FIG. 4 is a section along the line IV—IV in FIG. 3.

As illustrated in FIG. 2, fuel supply is provided by a fuel pump 31 driven by an electric motor 30 which aspirates fuel from a fuel container 32 and delivers it through a line 33 to a chamber 34 of a differential pressure valve 35. From the chamber 34, fuel flows through a line 36 into a chamber 37 of a fuel metering valve assembly 38 including a plunger 39, the end face 40 of which extends into the chamber 37. This chamber 37 communicates via bores 41 and 42 with an annular groove 43 in the plunger 39. The annular groove 43 has a control edge 44 which overlaps to varying degrees a control slit 46 disposed in a surrounding bushing 45. Fuel metered out by the control slit 46 flows into a collection chamber 47 and into the axial bore 27 and from there through the lateral bore 26, the annular groove 25 and the line 24 to the injection nozzle 21. The plunger 39 is displaced in the axial direction in dependence on the aspirated air quantity by means of an actuating rod 49. As illustrated in FIG. 3, the end of the actuating rod 49 remote from the plunger 39 is carried by an actuator 50 which is fixedly attached to the bearing shaft 7 of the air flow rate meter 3. The illustrated manner of transmitting the displacement of the air flow rate meter 3 to the fuel metering valve assembly 38 is only exemplary and could be performed by other means, for example by cam plates or gear trains or the like.

The fuel metering valve assembly 38 meters out fuel at constant pressure difference. The constant pressure difference is maintained by a differential pressure valve 35 which includes a diaphragm 51 defining chambers 34 and 52. The chamber 52 communicates via an air conduit 53, shown in dashed lines, with the induction tube upstream of the generating wing 10 so that the pressure in the chamber 52 is the same as that prevailing downstream of the control slit 46. A spring 55 located in the chamber 52 exerts a closing force on the differential pressure valve 35. The force of the spring 55 may be changed in dependence on operational variables of the engine. For example, there may be provided an electromagnet 56 which engages the spring 55 via a pin 57, or an additional force may be applied to the diaphragm 51 in parallel with the spring 55 and in dependence on operational variables. For example, the electromagnet 56 may be controlled by an electronic controller 58 which receives a signal from an oxygen sensor 59 which measures the partial pressure of oxygen in the exhaust line or by a signal from a temperature sensor 60. The force on the diaphragm 51 could also be modified, for example, by a bimetallic spring dependent on the operational temperature of the engine. The differential pressure valve 35 is shown as a flat seat valve with a movable diaphragm 51 and a fixed valve seat 61 across which fuel flows into a return line 62 terminating in the fuel container 32. The differential pressure valve serves at the same time as a system pressure control valve.

There are two advantages derived from the application of induction tube pressure upstream of the generating wing 10 as counter pressure at the metering location 44, 46 through the air opening 28. One of these advantages is the prior treatment of metered out fuel with air and a further advantage is an open injection nozzle 21 may be used. Yet another advantage is that the differential pressure may be held constant across the metering location in a simplified manner.

FIGS. 3 and 4 illustrate further details of embodying the fuel metering cross section. The bushing 45 contains a metering aperture 65 with an axial control edge 66 which overlaps a groove 67 in the plunger 39 also having an axial control edge 68, thereby forming a metering aperture 69. The plunger is attached to a stop arm 71 by means of which the plunger may be rotated as illustrated in FIG. 4, so that the metering aperture may be altered by rotating the plunger, for example in dependence on operational parameters of the engine in addition to its basic axial displacement. The rotation of the plunger may be performed by a bimetallic spring 72 which engages the stop lever 71 during the warm-up of the engine into a position which enlarges the metering aperture 69 so that a larger fuel quantity is admitted and the fuel-air mixture is thereby enriched. A spring 73 urges the stop arm 71 against a stop 74 disposed in a member 75 affixed to the housing.

The member of operation of the fuel supply system according to the invention is as follows. When the engine is running, the fuel pump 31 driven by the electric motor 30 pumps fuel from the fuel container 32 and delivers it through the line 33 to the fuel metering valve assembly 38. At the same time the engine aspirates air through the air induction tube 1, 2 and 4, thereby displacing the air flow rate meter 3 as well as the generating flap 6 from their normal positions. The displacement of the generating flap 6 will depend on the arbitrarily set position of the throttle.

The fuel metering valve assembly 38 meters out fuel in accordance with the displacement of the air flow rate meter 3. The direct actuation of the metering valve assembly 38 by the air flow rate meter 3 results in a substantially constant ratio of the aspirated air to the metered out fuel. Metering takes place at constant pressure difference due to the presence of the differential pressure valve 35 although the closure force acting on the diaphragm 51 may be changed so as to permit adaptation to various operational conditions of the engine, for example by altering the effective force of the spring 55. Fuel injection takes place preferably through the injection nozzle 21 located in the edge surface of the generating wing 10 into the narrowest flow aperture, i.e., at the point of highest air speed so as to obtain as homogeneous a fuel-air mixture as possible. The restoring force acting on the air flow rate meter is exerted by hydraulic pressure provided by fuel in the chamber 37 and acting on the end face 40 of the plunger 39.

The throttle valve 5 is coupled to the accelerator of the engine and moves generally opposite the air flow during its opening motions within the recess or bulge 12. The damping wing 9 of the generating flap 6 follows the motions of the throttle valve 5 and is pressed against it due to the vacuum in the induction tube and both flaps are pressure balanced with respect to the exterior. Normally, the most serious flaws in the preparation of the fuel-air mixture and its distribution occur in the upper end of the partial load domain. Accordingly, the invention proposes to so embody the spring 14 acting as a restoring force for the generating flap 6 that, within the top end of the partial load domain, the generating wing 10 of the flap 6 experiences a pressure loss of approximately 15 percent. In that region, the damping wing 9 detaches itself from the surface of the throttle valve 5. Due to this relatively large and preselected pressure drop of approximately 15 percent at the generating flap, the air speeds in the narrowest flow aperture 23 become nearly twice as large as before, i.e., they reach magnitudes of approximately 120 to 140 m/sec. so that the radii of the individual fuel drops are of the order of 15 micrometers. The pressure loss in the upper end of the partial load domain can be made relatively large, according to the invention, because the invention also provides reducing the effective force of the spring 14 in the full load position of the throttle valve so that the pressure drop there is only approximately 3 percent at full load and prevents an excessive power loss. In order to effect this reduction at full load, the throttle valve 5 is equipped with an actuating member 18 which engages the leaf spring 15 during full load conditions and thus changes the effective point of attachment 19 of the spring 14 in the sense of causing a shortening of the spring 14 and a diminution of the restoring force.

The foregoing relates to preferred exemplary embodiments of the invention, it being understood that other variants and embodiments thereof are possible within the spirit and scope of the invention, the latter being defined by the appended claims.

What is claimed is:

1. In a fuel supply system for an internal combustion engine, said engine including an air induction tube containing an air flow rate meter and, seriatim, an arbitrarily actuated throttle plate pivoting on a shaft, said air flow rate meter being subjected to a restoring force and being coupled operatively to a fuel metering valve assembly for the purpose of metering out fuel to the induced air in relation to the air flow rate, the improvement comprising:

a fuel mixture generating member, mounted to pivot around said shaft of said throttle plate;

a bulging region of the induction tube configured to receive a portion of said pivoting mixture generating member during pivotal motions thereof;

adjustable spring means, attached to said mixture generating member to urge the same to pivot in the opposite direction from that urged by the air flow; whereby said mixture generating member is displaced by the air flow and tends to follow the motions of said throttle plate, the force of said spring means being such that the pressure drop across said mixture generator in the upper region of the partial engine load domain is selectable and is reducible in the full-load position of said throttle plate.

2. A fuel supply system as defined by claim 1, wherein said fuel mixture generating member includes a damping wing and a generating wing and wherein said fuel metering valve assembly includes a plunger having a control edge cooperating with a corresponding control edge in a surrounding bushing, thereby forming a fuel metering aperture, the improvement further comprising a differential pressure valve connected across said fuel metering aperture for maintaining constant the pressure difference thereacross, an air orifice in said generating wing for admitting air pressure upstream of said generating wing to be admitted as counter pressure to said fuel metering aperture, said differential pressure valve being a flat seat valve having a diaphragm as movable valve member, one surface of said diaphragm being affected by fuel pressure upstream of said fuel metering aperture and the other side of said diaphragm being affected by induction tube pressure upstream of said mixture generating wing as well as by the force of a spring.

3. A fuel supply system as defined by claim 1, wherein the pressure drop due to the force of said spring means in the upper region of the partial load domain of the engine is approximately 15 percent.

4. A fuel supply system as defined by claim 3, wherein the force of said spring means is reducible at the full-load position of said throttle plate in a manner that the pressure drop across the mixture generating member is approximately 3 percent.

5. A fuel supply system as defined by claim 4, further comprising actuator means connected to said throttle plate for engaging said spring means to thereby cause shortening thereof; whereby the pressure drop across the mixture generating member is reduced during full-load by shifting the point of attachment of said spring means.

6. A fuel supply system as defined by claim 5, wherein said mixture generating member includes a generating wing and a damping wing, said damping wing pivoting in said bulging region of said induction tube and generally tending to follow the motions of said throttle plate whereas said generating wing defines the narrowest air flow cross section within said air induction tube.

7. A fuel supply system as defined by claim 6, wherein said mixture generating wing includes an edge orifice for injecting fuel into said narrowest flow cross section defined between said edge surface and the induction tube wall.

8. A fuel supply system as defined by claim 7, wherein said fuel metering valve assembly includes a sliding plunger coupled by linkages to said air flow rate meter, said plunger having a control edge cooperating with the control edge in a surrounding bushing to thereby define a fuel flow cross section to varying degrees.

9. A fuel supply system as defined by claim 8, wherein said fuel metering aperture is a slit.

10. A fuel supply system as defined by claim 8, wherein said plunger has a groove and an axial control edge which variably overlaps an axial control edge in said metering aperture in the bushing surrounding said plunger to thereby define the metering cross section for fuel.

11. A fuel supply system as defined by claim 10, wherein said fuel metering cross section is changeable by axial displacement of said plunger and is also changeable by rotary displacement of said plunger.

12. A fuel supply system as defined by claim 11, wherein said plunger is displaceable axially in dependence on the position of said air flow rate meter and means are provided for rotating said plunger in dependence on engine variables.

* * * * *